United States Patent [19]

Beretta et al.

[11] 3,941,545

[45] Mar. 2, 1976

[54] MEANS FOR CURVING SIDE BY SIDE CONCRETE CURB SECTIONS

[75] Inventors: Angelo V. Beretta; David Beretta, both of Lincoln, R.I.

[73] Assignee: Durastone Company, Lincoln, R.I.

[22] Filed: Jan. 21, 1974

[21] Appl. No.: 434,987

[52] U.S. Cl. ..... 425/383; 425/403

[51] Int. Cl.[2] ..... B28B 11/00

[58] Field of Search ..... 425/289, 296–297, 425/301–305, 306–307, 315–316, 340, 343, 383, 398, 403; 264/280, 285, 295–296

[56] References Cited

UNITED STATES PATENTS

| | | | |
|---|---|---|---|
| 1,650,832 | 11/1927 | Hamer | 425/340 |
| 3,584,354 | 6/1971 | Jonell et al. | 425/306 |
| 3,824,059 | 7/1974 | Heltzel | 425/442 |

*Primary Examiner*—Robert D. Baldwin
*Assistant Examiner*—John McQuade
*Attorney, Agent, or Firm*—Salter & Michaelson

[57] ABSTRACT

Apparatus has heretofore been provided for the automatic pre-casting of concrete curbing. The pre-cast curbing, in a zero slump state, emerges in spaced parallel pairs from this apparatus. The present invention provides for an initial bending of both curbs in opposite directions by the insertion of a tool between them. Then, a final bending is performed to the desired curvature. The apparatus comprises an elongated prebending member having an inverted triangular section and convex sides from end to end. The maximum curvature is at the top, and it gradually tapers away toward the bottom so that the amount of curvature to the curbs is controlled by the depth of penetration of the member between the curbs. A second, generally inverted U-shaped member is formed with the required bend. This member is forced over one of the curbs to complete the bend. It is then lifted, turned 180°, and forced over the companion curb to complete its bend. The entire process must be performed within the first ten minutes of leaving the pre-casting apparatus, and preferably within the first three minutes, to ensure sufficient pliability in the curb before its setting.

6 Claims, 6 Drawing Figures

MEANS FOR CURVING SIDE BY SIDE CONCRETE CURB SECTIONS

BACKGROUND OF THE INVENTION

Concrete curbing has been pre-cast in molds made to conform to the required road conditions, straight and curved. The molds, especially for the curved requirements, have been built for each job separately. However, automatic machines have been devices for pre-casting concrete curbing in a continuous automatic process. The curbing emerges from these machines in straight lengths, two at a time in side-by-side relation. They are then kiln cured and ready for use. Since the machine makes only the straight curbing, the curved sections must still be largely individually cast to order, or else straight sections, having mitered ends, are aligned to go around curves.

SUMMARY OF THE INVENTION

The present invention provides means for bending the pre-cast curbing as it emerges from the automatic machine and before it is set. The pre-cast concrete curbing is conventionally formed with one vertical side which may taper inwardly at the upper end, and one slanted side, wider at the base and slanted to a narrower top. The curbs emerge from the machine in pairs, approximately an inch apart, with the slanted sides facing each other to form a V-shaped space therebetween. An elongated prebending member is provided in a V-shaped section and having convex sides curving from end to end. The prebender is inserted into the V-space to force the curbs to bend away from each other in opposite curves. The amount of bend can be controlled by the depth of insertion of the prebender—the deeper the insertion, the greater the bend. The final step is performed with an elongated, inverted U-shaped bending tool which is formed with the required bending radius, a different tool being provided for each radius. This tool is forced over one of the prebent curbs to complete the final curvature. The tool is then lifted, turned 180°, and forced over the adjacent curb to complete it. The curved curbs can then be kiln set in the usual manner.

DESCRIPTION OF THE DRAWINGS

In the drawings which illustrate the best mode presently contemplated for carrying out the instant invention.

DESCRIPTION OF THE INVENTION

In an application entitled CONCRETE PRODUCT METHOD AND MOLDING MACHINE FOR PRODUCING SAME, Ser. No. 263,447, filed June 16, 1972, now U.S. Pat. 3,824,059, issued July 16, 1974, there is described an apparatus for automatically and continuously forming pre-cast concrete curbing. The curbing emerges from this machine freshly formed and undried but in a zero slump state so that bending operations can be performed without disturbing the dimensions of the curbing.

Figure 1:
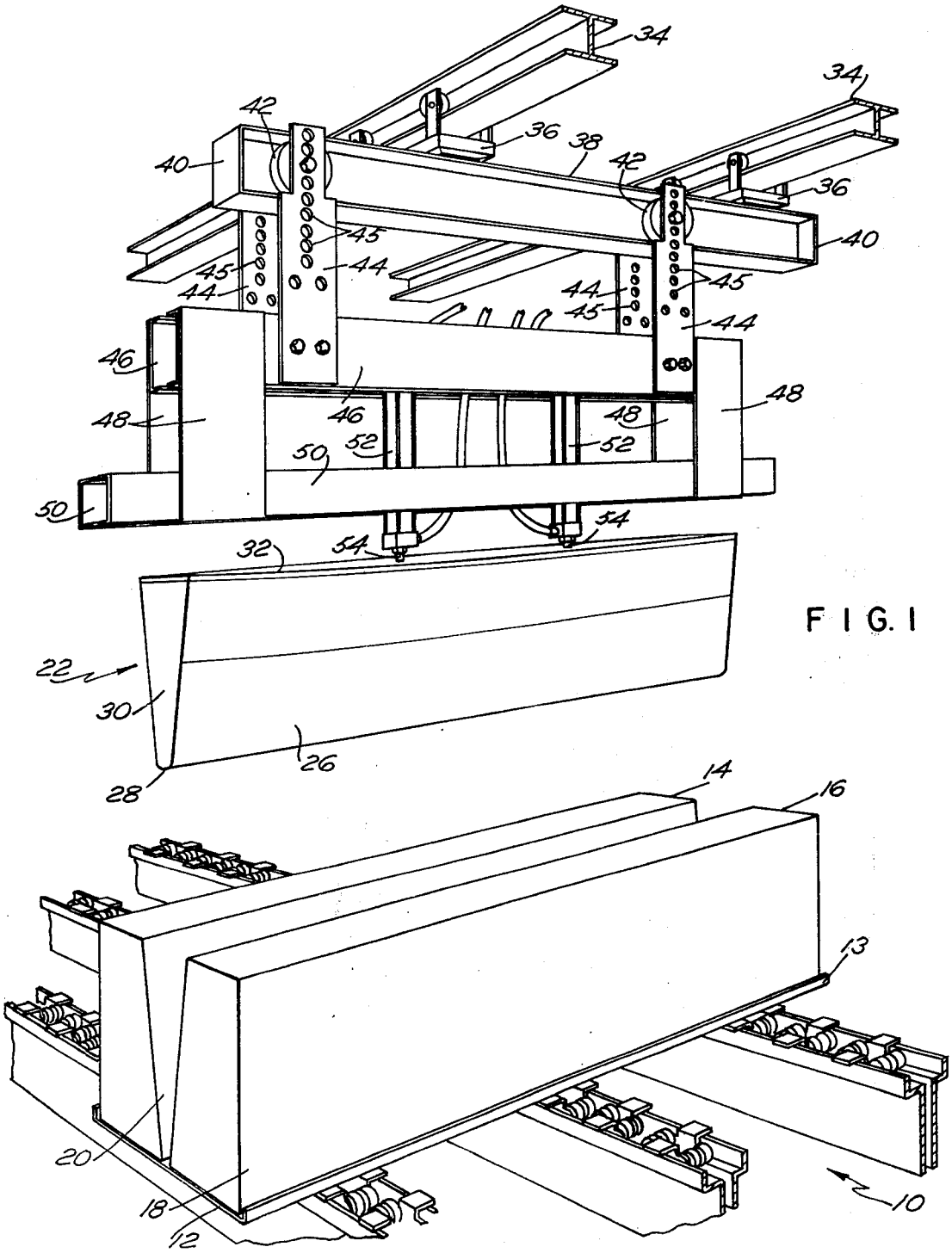
FIG. 1 is a perspective view of the prebending device in position over a pair of pre-cast concrete curbs.

FIG. 1 illustrates the curbing as it emerges from the automatic pre-casting machine above referred to. A conventional conveyor belt arrangement 10 supports the plate 12 bearing a pair of pre-cast curbs 14 and 16. The plate 12 forms the bottom of the mold in the machine so that the curbs are cast directly on it. The plate is preferably of 5/16 inch steel, a little over six feet long to handle the six-foot curbs, and 23 inches wide with flanges 13 along the sides. At the base, each curb is ten inches wide, spaced about an inch from each flange, and spaced about an inch from each other in the center. The curbs are approximately eighteen inches in height with straight outer sides 18 and slanted inner sides 20. They are positioned, see FIGS. 1 and 2, with their slanted sides 20 in opposed relation to form a V-shaped space therebetween.

At this stage, with the curbs 14 and 16 emerging from the pre-casting machine (not shown), the concrete is still moist and unset but in a zero slump condition which permits handling without disturbing the dimensions. The bending operations of the present invention should therefore be performed within the first ten minutes, and preferably within the first three minutes, of leaving the pre-casting machine, or else the concrete will have hardened to the extent that bending can no longer be effected.

Figure 4:
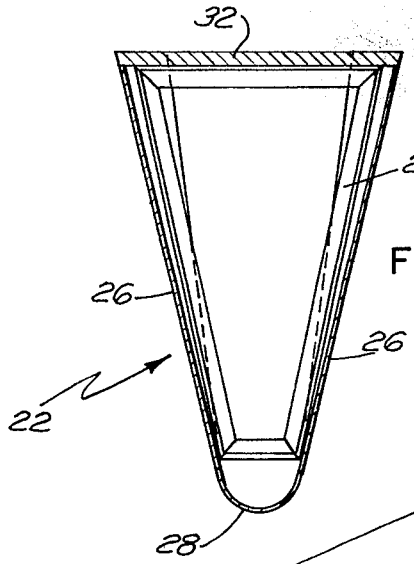
FIG. 4 is a transverse section of the prebending tool.
Figure 5:
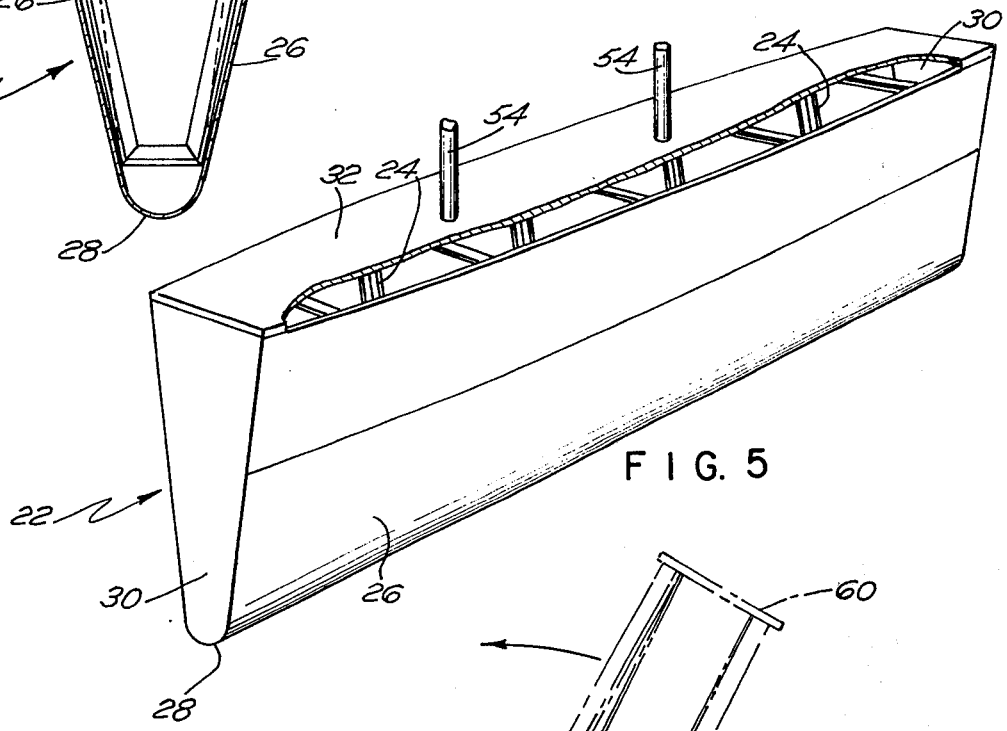
FIG. 5 is a perspective view, partly broken away, of the prebending tool.

The first step of the present invention is an initial pre-bending, the amount of pre-bend depending on the degree of bending required in the final operation. The pre-bend is performed by the construction shown in FIGS. 1, 4 and 5. The pre-bending tool 22 comprises an elongated blade-like body having a substantially V-shaped section. A supporting frame 24 is covered with metal sheeting 26 at the sides, 28 at the rounded bottom end, 30 at each end wall, and the flat top 32. The sides 26 are convex, curving out at the center, and the curvature is greatest at the top and gradually decreases toward the bottom edge. The curbs are eighteen inches in height, and the tool 22 is sixteen inches high. The curvature is such that when the tool is inserted between the pair of curbs, a fourteen-inch penetration provides about a fifty-foot radius curve, and a fifteen-inch penetration provides about a thirty-foot radius curve.

The tool 22 is maneuvered and operated by the construction shown in FIG. 1. A pair of spaced I-beams 34 are mounted overhead above the conveyor 10. A carriage 36 rides along each I-beam 34 in the conventional manner. An I-beam 38 is mounted below the carriages 36 and extends transversely of the conveyor. The I-beam 38 is provided with an end wall 40 at each end to form stops. Spaced wheels 42 are mounted on each side of the I-beam 38, each wheel supporting a vertical plate 44. The plates 44 are provided with a vertical row of openings 45 to permit adjustment. At their lower ends, the plates 44 support a pair of channel members 46 in horizontal position. At each end, the members 46 are provided with depending plates 48 which hold a smaller pair of channel members 50 in horizontal position parallel to the members 46. A pair of spaced hydraulic or pneumatic cylinders 52 are mounted between the members 46 and 50 together with their associated line connections for moving the pistons and the piston rods 54 vertically. Note that the lower ends of the piston rods 54 are attached to the top 32 of the tool 22, FIGS. 1 and 5.

In operation, the plate 12 rides out of the precasting machine on the conveyor 10 into the position shown in FIG. 1, with the two pre-cast concrete curbs extending transversely of the conveyor. The carriages 36 allow the assembly to be pulled along above the conveyor until the tool is positioned over and between the curbs. The wheels 42 also allow transverse adjustment to longitudinally center the tool 22. The cylinders 52 are now activated to move the rods 54 downwardly and push the tool 22 between the curbs 14 and 16. As stated hereinabove, the depth of the penetration of the tool 22 determines the extent of curvature imparted to the curbs. This is determined by the final curvature required, so that the final curvature can be reached in two easy stages without undue strain on the curbs. The desired depth of penetration of the tool 22 between the curbs is achieved by mounting rollers 42 to plates 44 at the proper openings 45.

Figure 2:
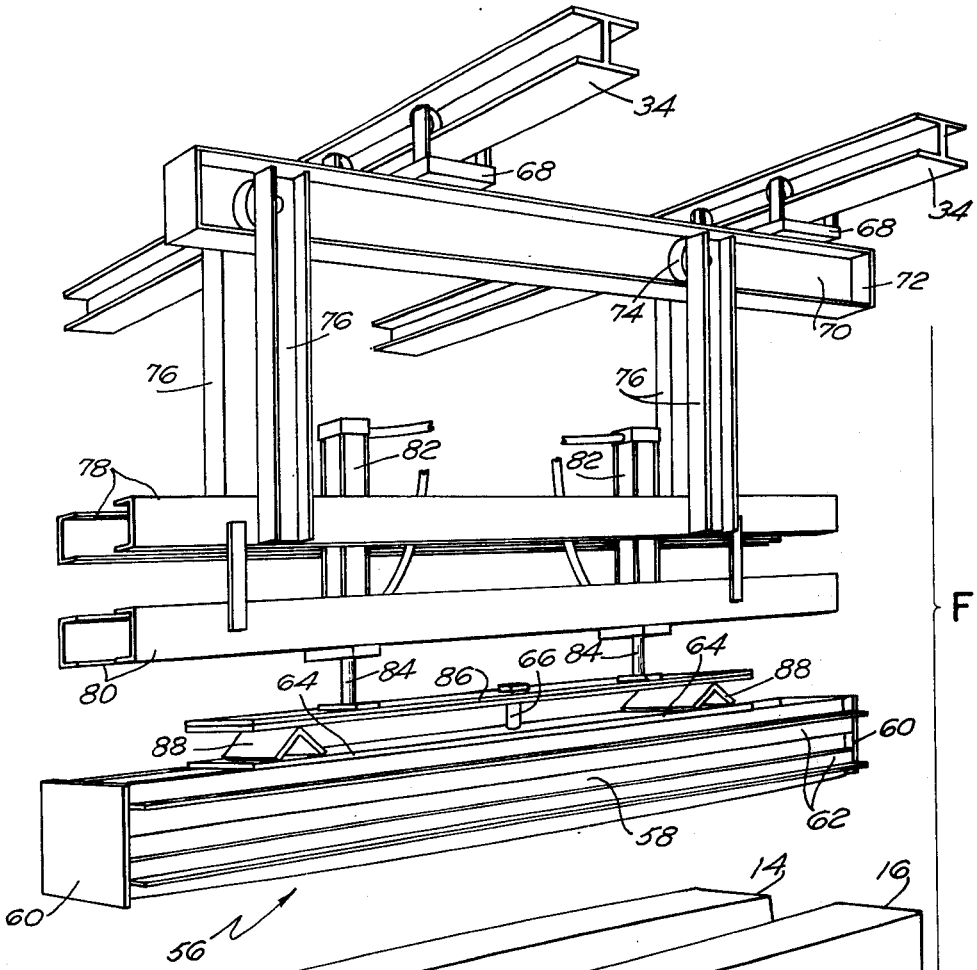
FIG. 2 is a perspective view of the final bending device in position over the pair of pre-cast curbs after their prebending.
Figure 3:
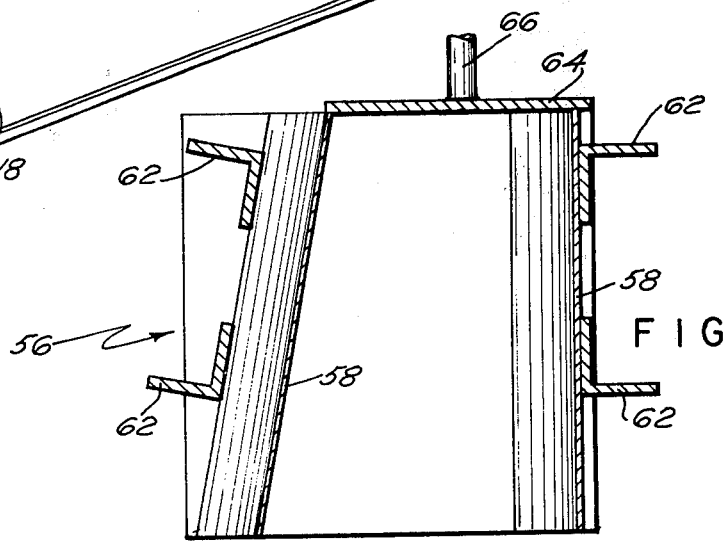
FIG. 3 is a transverse section of the final bending tool.
Figure 6:
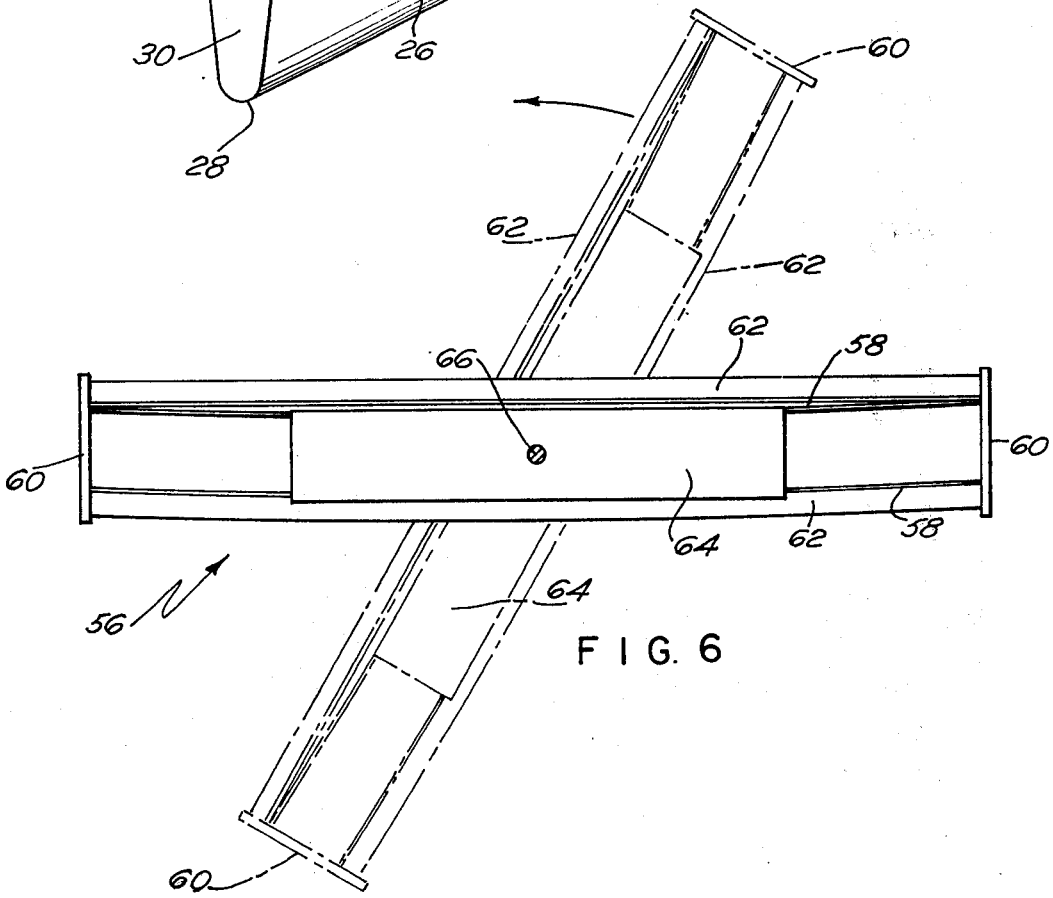
FIG. 6 is a top plan view of the final bending tool showing its pivoting action.

The final bending is performed by the structure shown in FIGS. 2, 3 and 6. The final bending tool 56 must be provided for each particular curvature desired. It comprises a frame having pair of parallel spaced curved plates 58 held in proper curved position by the end pieces 60 which are rigidly connected by the longitudinal angle irons 62 to form a strong supporting frame for the plates 58. An elongated central rectangular plate 64 is mounted at the top to hold the plates in proper spaced relation. The tool 56 is supported in the center by a single pivot rod 66 connected to plate 64.

The tool 56 is mounted on a maneuvering and operating assembly very similar to the one for the prebending tool 22. The assembly rides along the same two I-beams 34 with carriages 68 supporting the I-beam 70 with end walls 72, all identical to the structure shown in FIG. 1. Spaced wheels 74 ride on each side of the I-beam 70, each supporting a vertical channel iron 76. Depending from the lower end of the channel irons 76 are spaced parallel horizontal channel irons 78, and depending from the channel irons 78 are a pair of identical channel irons 80. Spaced vertical cylinders 82 are mounted between the channel irons 78 and 80, their operating piston rods 84 supporting a plate 86 from which the pivot pin 66 depends to pivotally support the tool 56. At each end of the plate 64, a short piece of angle iron 88 fills the space between the tool 56 and the plate 86 to stabilize the tool in horizontal position.

In operation, after the prebending with the tool 22 as hereinabove described, the tool 22 is rolled out of the way, and the assembly shown in FIG. 2 is rolled into its place. The tool 56 is positioned over one of the curbs, 14 for example, and forced down over the curb to provide the final bending. The tool 56 is now lifted and manually pivoted (dot-dash lines in FIG. 6) 180°. The assembly is now maneuvered to swing the tool 56 over the other curb 16 which faces the other way. The tool 56 is now brought down, and the curb 16 is bent. Both curbs 14 and 16 have now been bent to the final curvature determined by the final tool 56. They can now be sponge finished and kiln set.

The bending of the pre-cast concrete curbs is thus accomplished in two stages. The first stage includes a prebending tool which can impose a varying degree of curvature depending on its depth of penetration between adjacent curbs whereby the desired prebend or curve is obtained. Thus a single prebending tool can be universally used for all the curves. The second and final bending operation must be performed with a tool designed for the particular curve. Therefore, a plurality of final tools are required for the bending to different requirements.

The above construction permits a rapid operation well within the optimum three minutes after the initial casting. The devices are simple in construction and economical to manufacture and use. Other advantages of the present invention will be readily apparent to a person skilled in the art.

What is claimed is:

1. Apparatus for bending unset pre-cast zero slump concrete curbing emerging in paired lengths in spaced parallel relation from an automatic casting machine, said curbing having inclined sides in facing relation whereby the space between each pair of curbing is substantially V-shaped, said apparatus comprising first means for simultaneously prebending each pair of curbing, said first means comprising an elongated blade-like tool having a pair of converging side walls whereby said tool is substantially V-shaped in cross section, each of said side walls having a gentle convex curvature from end to end, said tool being dimensioned so as to wedgingly engage between said pair of curbing, first means for forcing said tool inwardly between said pair of curbing whereby said convex sides automatically and simultaneously cause bending of said spaced curbing, a second tool operable after removal of said first tool from between said curbing to finalize the bend of said curbing, said second tool comprising an elongated frame having end walls and parallel side walls curved to the desired final radius of said curbing, and second means for forcing said frame over said prebent curbing.

2. In the apparatus of claim 1, the convex curvature of said first tool gradually decreasing from the top to the bottom of said side walls, whereby the depth of penetration of said first tool between said curbing determines the extent of pre-bending thereof, and means for adjusting said depth of penetration.

3. In the apparatus of claim 1, means operable for first forcing said second tool over one curbing of each pair and then over the other.

4. In the apparatus of claim 3, said operable means comprising a pivot mounting for said second tool, whereby after engagement with the first curbing, said second tool may be swung 180° so as to be properly positioned for engagement with the other curbing.

5. Apparatus as in claim 1, wherein said first forcing means comprises a pair of supporting tracks mounted horizontally above the curbs, a carriage riding on each of said tracks, an I-beam mounted across said carriages transversely to said tracks, spaced wheels riding on said I-beam, horizontal supports depending from said wheels, a pair of spaced hydraulic cylinders vertically mounted in said supports, and piston rods extending downwardly from said cylinders, said tool being mounted on said rods.

6. Apparatus as in claim 1, wherein said second forcing means comprises a pair of supporting tracks mounted horizontally above the curbs, a carriage riding on each of said tracks, an I-beam mounted across said carriages transversely to said tracks, spaced wheels riding on said I-beam, horizontal supports depending from said wheels, a pair of spaced hydraulic cylinders vertically mounted in said supports, piston rods extending downwardly from said cylinders, a plate carried by said rods, and a central pivot pin depending from said plate, said second tool depending from said pivot pin.

* * * * *